United States Patent [19]

Phillips

[11] 4,204,136

[45] May 20, 1980

[54] DUAL LAYER PHOSPHOR SCREEN FOR CATHODE RAY TUBE

[75] Inventor: Donald M. Phillips, Cayuta, N.Y.

[73] Assignee: Westinghouse Electric Corp., Pittsburgh, Pa.

[21] Appl. No.: 887,895

[22] Filed: Mar. 17, 1978

[51] Int. Cl.[2] ..... H01J 29/18; H01J 29/30

[52] U.S. Cl. ..... 313/473; 204/181 R; 427/69

[58] Field of Search ..... 313/473

[56] References Cited

U.S. PATENT DOCUMENTS

| | | | |
|---|---|---|---|
| 2,590,018 | 3/1952 | Koller et al. | 313/473 |
| 2,958,002 | 10/1960 | Cusano et al. | 313/473 |
| 3,231,775 | 1/1966 | Pritchard | 313/473 |
| 3,525,679 | 8/1970 | Wilcox et al. | 204/181 |
| 3,819,409 | 6/1974 | Phillips | 117/211 |
| 3,904,502 | 9/1975 | Phillips | 313/473 X |
| 4,025,662 | 5/1977 | Sumner | 427/157 |

*Primary Examiner*—Robert Segal

*Attorney, Agent, or Firm*—W. G. Sutcliff

[57] ABSTRACT

A cathode ray tube is described having a high brightness, high resolution cathodoluminescence screen which exhibits a low noise level. Two discrete phosphor layers are provided on the interior of the tube faceplate. A thin electrophoretically deposited first phosphor layer of very finely divided phosphor is disposed upon the interior surface of the tube faceplate. A second gravity settle phosphor layer is disposed over the first phosphor layer.

4 Claims, 1 Drawing Figure

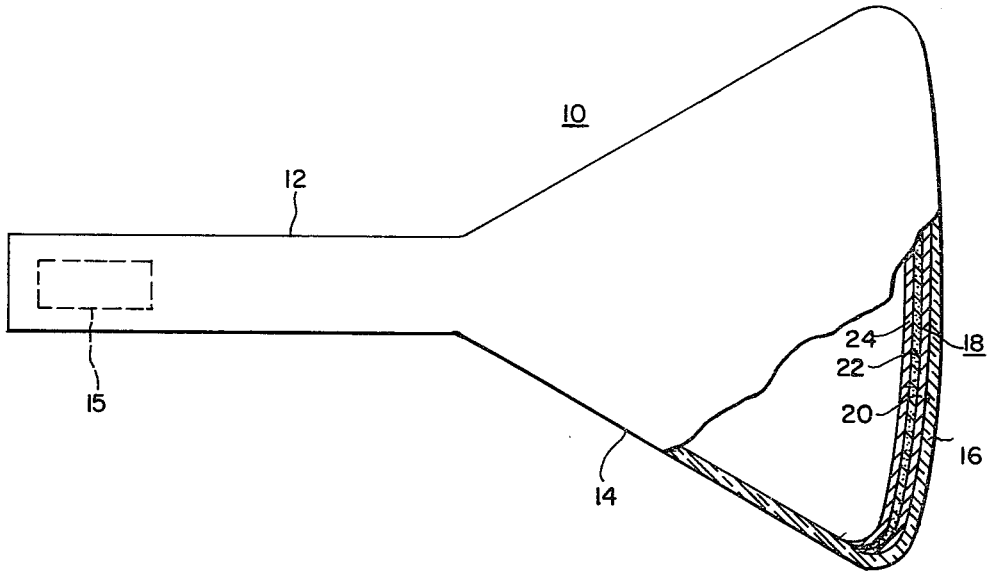
10
12
15
14
24
22
20
18
16

DUAL LAYER PHOSPHOR SCREEN FOR CATHODE RAY TUBE

BACKGROUND OF THE INVENTION

The present invention relates to cathode ray tubes of the display or image type, and more particularly to an improved high brightness, high resolution screen which exhibits low noise level. The typical cathode ray tube user desires a screen having a high efficiency or high brightness of light output with high image resolution and low noise level. The screen noise level is measured as a function of the light output variation across a uniformly scanned line, and is thought to result from voids in the phosphor layer structure.

It has been the practice when high resolution low noise levels are required for the phosphor screen to use a cataphoretic deposition process for laying down the phosphor screen upon the tube faceplate. Such a cataphoretic deposition process is set forth in U.S. Pat. No. 3,525,679, owned by the assignee of the present invention. In such a cataphoretic deposition process, a conductive film is first deposited upon the faceplate and the finely divided phosphor electro-deposited upon this conductive layer from an electrolyte containing solution. Such electrophoretically deposited phosphor layers are typically very thin such as about 4 microns or several particle thicknesses thick. The conductive layer is thereafter removed from underneath the phosphor layer by treatment with a potassium cyanide solution and water flushing. Such electrophoretically deposited phosphor screens however have serious brightness limitations by way of comparison the brightness level of light output of a cataphoretic screen as compared to a more conventional gravity settled screen is about one-half the gravity screen brightness at a given screen current. The conventional gravity settled phosphor screens which have been used for some time in display and image cathode ray tubes while exhibiting high brightness levels is incapable of the high resolution and low noise level achievable with cataphoretically deposited screens.

It is desired to be able to achieve the highest possible screen brightness level with the highest possible resolution and low noise level characteristic for a cathode ray tube phosphor screen.

SUMMARY OF THE INVENTION

A cathode ray tube phosphor display screen is provided which exhibits high brightness and high resolution with low noise level. The phosphor screen comprises two phosphor layers, a first electrophoretically deposited phosphor layer of very finely divided phosphor particles is disposed upon the interior surface of the tube faceplate. A second gravity settled phosphor layer is then deposited on the first phosphor layer.

BRIEF DESCRIPTION OF THE DRAWINGS

FIG. 1 is a schematic representation of a cathode ray tube partly cut away to schematically show the display screen on the interior of faceplate surface.

DESCRIPTION OF THE PREFERRED EMBODIMENT

The cathode ray tube 10 of the present invention is seen in FIG. 1 and comprises a hermetically-sealed glass envelope which includes a neck portion 12, a funnel portion 14 and a faceplate portion 16. An electron gun

15 is shown in phantom disposed in the neck portion of the tube. A double level phosphor screen 18 is disposed on the interior surface of faceplate portion 16 of the cathode ray tube. A phosphor screen 18 is seen in detail in FIG. 1 wherein a first phosphor layer 20 of cataphoretically or electrophoretically deposited zinc sulphide activated by silver (P-11) phosphor is disposed upon the glass substrate. The representations of the sole FIGURE show the phosphor screen after removal of a conductive layer which is used to electrophoretically deposit the phosphor upon the glass substrate. The details of the electrodeposition process are more fully set forth in U.S. Pat. No. 3,525,679, the details of which are incorporated herein by reference. In general, it has been found desirable to deposit the cataphoretic phosphor layer 20 in a thickness which is about half that normally deposited for a standard cataphoretic screen. The phosphor utilized is a finely divided phosphor with approximately one micron average particle diameter and the phosphor layer 20 is typically about 1 to 2 microns in thickness. This very thin cataphoretic phosphor layer 20 is provided by controlling the deposition parameters which include deposition time, anode to cathode panel spacing, solids contact with the suspension, and applied D.C. voltage. In practice, the deposition time is varied and shortened to reduce the thickness of the cataphoretic screen. As set forth in greater detail in the aforementioned prior art patent, the cataphoretically deposited screen is then baked and treated with potassium cyanide to remove the conductive film. A second gravity settled phosphor layer 22 is disposed upon the cataphoretic phosphor layer 20. The gravity settled phosphor is also a finely divided phosphor which is again zinc sulfide silver activated. A particularly effective phosphor which has been used is an aluminum oxide coated phosphor which is Lumilux Blue P11-02 available from the American Hoechst Corporation, Somerville, N.J.

The gravity settled phosphor layer can be laid down either upon the faceplate prior to its connection to the funnel portion of the cathode ray tube or can be applied after the faceplate is frit sealed to the above one. The gravity settled phosphor layer is deposited by a process in which finely divided phosphor which has about a 2 to 3 micron average particle size is mixed and subjected to ultrasonic dispersion and elutriated to obtain this finely divided particle size suspension. No special preparation of the cataphoretic phosphor layer 20 is necessary. The gravity settled slurry includes a deionized water base, a strontium acetate electrolyte which is present in an amount of about 0.6 grams per liter, and a binder additive of potassium silicate present in amount of about 50 milliliters of 14% silicate solution per liter of slurry. The phosphor is present in amounts sufficient to provide a solids content of about 2 miligrams per cc of slurry. The slurry settling time is such to provide a phosphor layer 22 which is less than about 10 microns in thickness. A thin electron transmissive anode layer 24 of aluminum is provided over the second phosphor layer 22.

The light output from such a dual level phosphor screen having a cataphoretic phosphor layer in a gravity settled phosphor layer is less than the brightness level had from a conventional gravity settled screen. The light output from such a double level phosphor screen is however significantly greater than for a cataphoretic screen. The brightness improvement at a given screen current varies from about 50% improvement to approximately 100% improvement in light output in going from relatively low screen current to relatively high screen current. This brightness level is achieved while maintaining a low noise ratio in which the peak to peak noise level variation for the double level screen of the present invention is about 3%, whereas for a conventional gravity settled high brightness screen, the more typical noise level is approximately 10%.

What is claimed is:

1. A cathode ray tube having a high brightness with low noise level, high resolution cathodoluminescent display screen disposed upon the interior surface of the tube faceplate, which display screen comprises a thin electrophoretically deposited first phospher layer of very finely divided phosphor disposed upon the interior surface of the tube faceplate and a second gravity settled phosphor layer which is disposed on the first phosphor layer.

2. The cathode ray tube set forth in claim 1, wherein the thin electrophoretically deposited first phosphor layer is deposited in a single particle thickness of about 1–2 microns, and the second gravity settled phosphor layer comprises finely divided phosphor particles deposited to a thickness of less than about ten microns.

3. A method of fabricating a phosphor display screen for a cathode ray tube, which screen in operation exhibits high resolution and brightness at low operating noise level, which method comprises;

electrophoretically depositing a finely first phosphor layer upon the interior surface of the tube faceplate to a thickness of about an average particle size;

gravity settling from an aqueous dispersion a second phosphor layer of finely divided phosphor particles to a layer thickness of less than about ten microns.

4. The method set forth in claim 3, wherein said electrophoretic deposition is carried out by first depositing a conductive layer on the tube faceplate interior surface and then the first phosphor layer is electrophoretically deposited thereon from solution, with the conductive film then removed through the first phosphor layer by treatment with potassium cyanide, with the gravity settling of the second phosphor layer thereafter.

* * * * *